United States Patent [19]

Horodysky

[11] Patent Number: 4,511,482

[45] Date of Patent: Apr. 16, 1985

[54] N-HYDROCARBYLHYDROCARBYLENEDIAMINE CARBOXYLATE AND LUBRICANTS CONTAINING SAME

[75] Inventor: Andrew G. Horodysky, Cherry Hill, N.J.

[73] Assignee: Mobil Oil Corporation, New York, N.Y.

[21] Appl. No.: 508,980

[22] Filed: Jun. 29, 1983

[51] Int. Cl.[3] ..... C10M 1/36

[52] U.S. Cl. ..... 252/34; 252/51.5 A; 252/401; 562/451; 562/507

[58] Field of Search ..... 252/34, 51.5 A, 401; 562/451, 507

[56] References Cited

U.S. PATENT DOCUMENTS

| | | | |
|---|---|---|---|
| 3,884,947 | 5/1975 | Badin et al. | 252/51.5 A |
| 3,907,704 | 9/1975 | Murphy | 252/34 |
| 4,239,635 | 12/1980 | Rieder | 252/34 |

*Primary Examiner*—Jacqueline V. Howard

*Attorney, Agent, or Firm*—Alexander J. McKillop; Michael G. Gilman; Claude E. Setliff

[57] ABSTRACT

Amide carboxylate salts of certain diamines are provided. These compounds give excellent results when tested in lubricants as, among other things, friction reducing additives.

22 Claims, No Drawings

N-HYDROCARBYLHYDROCARBYLENEDIAMINE CARBOXYLATE AND LUBRICANTS CONTAINING SAME

BACKGROUND OF THE INVENTION

1. Field of the Invention

The invention relates to lubricant compositions. More particularly, it relates to a group of N-hydrocarbylhydrocarbylene-diamine amide carboxylates and to their use in lubricants and fuels as multipurpose additives, i.e., as friction reducers, antioxidants and fuel consumption reducers. They are also expected to exhibit antirust and detergent characteristics in engines when used in lubricants and in carburetors and intake manifolds when used in gasolines. The invention is especially concerned with using the compositions in connection with internal combustion engines.

2. Discussion of Related Art

As those skilled in this art know, additives impart special properties to lubricants and fuels. They may give these new properties or they may enhance properties already present. One property all lubricants have in common is the reduction of friction between materials in contact. Nonetheless, the art constantly seeks new materials to enhance such friction properties.

A lubricant, when used without additives in an internal combustion engine, will not only reduce friction, but in the process will also reduce consumption of the fuel required to run it. When oils appeared to be inexhaustable, and were cheap, minimum attention was given to developing additives for the specific purpose of increasing functional properties. Instead, most of the advances in this area came as a result of additives being placed in lubricants for other purposes. However, recent events have spurred research programs designed specifically to find materials capable of enhancing the ability of a lubricant to reduce friction.

We have in our work found that there is not necessarily a correlation between friction reducing properties of an additive and its ability correspondingly to further reduce fuel consumption in an engine. That is, one cannot, with certainty, predict from the ability of an additive to reduce friction that it will also act to decrease fuel consumption. Thus, even though the use of amides in lubricants is known (see U.S. Pat. No. 3,884,822, for example, which discloses lubricants containing the product of reaction between an aminopyridine and oleic acid), no art teaches or suggests that the products of this invention are useful for the purposes disclosed herein.

SUMMARY OF THE INVENTION

In accordance with the invention, there is provided a lubricant or liquid fuel composition comprising a major proportion of a lubricant or fuel and a friction reducing, a fuel consumption reducing a detergent, or an antioxidant amount of an N-hydrocarbylhydrocarbylene-diamine amide carboxylate of the formula

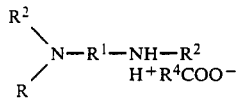

wherein R is a hydrocarbyl group containing 6 to 20 carbon atoms, R preferably being alkyl or alkenyl, $R^1$ is a $C_2$ to $C_3$ hydrocarbylene group, preferably an alkylene group, $R^2$ is hydrogen or $R^3C{=}O$, wherein at least one $R^2$ is $R^3C{=}O$, $R_3$ being hydrogen or a $C_1$ to $C_6$ alkyl group, and $R^4$ is a $C_{10}$ to $C_{20}$ hydrocarbyl group, preferablky a linear alkyl or alkenyl group.

The invention also provides the compounds.

DESCRIPTION OF SPECIFIC EMBODIMENTS

The diamine amides can be made by any method known to the art. In general, they can be made in two steps by reacting an N-alkylalkylene-diamine of the formula

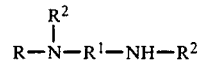

with an acid or ester of the formula $R^3COOR^3$ to form the amide, and then a second step reacting the product formed with an acid of the formula $R^4COOH$ to form the carboxylate. R, $R^1$, $R^2$, $R^3$ and $R^4$ are as herein defined.

The general reaction conditions are not critical. Reaction can take place between the diamine and the acid at a temperature of between about 80° C. and about 260° C., preferably about 120° C. to about 160° C. The reaction will usually be completed in from 2 to 10 hours, but where the reactants demand it, up to 24 hours may be required for reaction completion. In the second step the reaction can take place between 20° C. and 100° C., preferably between 50° C. and 70° C. The reaction can usually be completed in several hours or less, generally within an hour or so.

Hydrocarbon solvents, or other inert solvents may be used in the reaction. Included among the useful solvents are benzene, toluene and xylene. In general, any hydrocarbon solvent can be used in which the reactants are soluble and which can, if the products are soluble therein, be easily removed.

In carrying out the first reaction, the molar ratio of diamine to acid can range from about 1.5:1 to about 1:1.5, but preferably will range from about 1.2:1 to about 1:1.2. In the second reaction, the mole ratio of diamineamide to acid can range from about 1.5:1 to about 1:5, but to acid can range from about 1.5:1 to about 1:1.5, but preferably will range from about 1.2:1 to about 1:1.2.

Some of the useful diamines include N-oleyl-1,3-propylenediamine, N-coco-1,3-propylenediamine, N-tallow-1,3-propylenediamine, N-stearyl-1,3-propylenediamine, N-hydrogenated tallow-1,3-propylenediamine, N-soya-1,3-propylenediamine, N-hexadecyl-1,3-propylenediamine, N-dodecyl-1,3-propylenediamine, N-linoleyl-1,3-propylenediamine and mixtures of two or more of these. All the R groups mentioned are alkyl or alkenyl. Others, such as an aryl group, an alkaryl group, an aralkyl group or a cycloalkyl group, are included. The aryl portion will contain 6 to 14 carbon atoms and will include the phenyl, naphthyl and anthryl groups. As the above formula indicates, the compounds for use in step 1 include formic, acetic, propionic and butyric acids as well as the correspondence esters.

In step 2, the useful acids include oleic acid, stearic acid, iosotearic acid, linoleic acid, tall oil acid, dodecanoic acid, isomeric tridecanoic acid, hexadecanoic acid, lauric acid, myristic acid and mixtures thereof.

While the reaction outlined is the usual, and preferred one, other reactions may be used to prepare the diamine amides. For example, formate esters can be reacted with the diamines to produce diamine amides as defined above by ammonolysis of such esters. For instance, methyl formate can be reacted with the diamine to form diamine formamides. The reaction is generally exothermic and proceeds at temperatures of from about 50° C. to about 125° C. Ratios of reactants, i.e., etherdiamine and formate ester, may be from about 1.5:1 to about 1:1.5, preferably about 1:1 to about 1:1.2.

The carboxylate can be formed by reacting a moderate molecular weight organic monocarboxylic acid to form carboxylate, thus reacting with some of the free nitrogen to produce a partial carboxylate salt. This reaction can be carried out at from about 20° C. to about 100° C., preferably at least 40° C. to about 70° C.

An important feature of the invention is the ability of the additive to improve the resistance to oxidation of oleaginous materials such as lubricating oils, either a mineral oil or a synthetic oil, or mixtures thereof, or a grease in which any of the aforementioned oils are employed as a vehicle. In general, mineral oils, both paraffinic, naphthenic and mixtures thereof, employed as a lubricating oil or as the grease vehicle, may be of any suitable lubricating viscosity range, as for example, from about 45 SSR at 100° F. to about 6000 SSU at 100° F., and preferably from about 50 to about 250 SSR at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in preference to mixtures of mineral and synthetic oils, various synthetic oils may be successfully utilized. Typical synthetic vehicles include polyisobutylenes, polybutenes, hydrogenated polydecenes, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers typified by a butyl-substituted bis(p-phenoxy phenyl)ether, phenoxy phenylethers.

It is to be understood that the compositions contemplated herein can also contain other materials. For example, other corrosion inhibitors, extreme pressure agents, viscosity index improvers, coantioxidants, antiwear agents and the like can be used. These include, but are not limited to, phenates, sulfonates, succinimides, zinc dialkyl dithiophosphates, and the like. These materials do not detract from the value of the compositions of this invention; rather the materials serve to impart their customary properties to the particular compositions in which they are incorporated.

Mineral oil heat exchange fluids particularly contemplated in accordance with the present invention have the following characteristics: high thermal stability, high initial boiling point, low viscosity, high heat-carrying ability and low corrosion tendency.

Further, the transmission fluids of consequence to the present invention are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions. Specifications for low-temperature and aircraft fluids are defined in U.S. Government Specification MIL-H-5606A.

In addition, the oxidation and corrosion resistance of functional fluids such as hydraulic fluids can be improved by the adducts of the present invention.

The products of this invention can also be employed in liquid hydrocarbon fuels, alcohol fuels or mixtures thereof, including mixtures of hydrocarbons, mixtures of alcohols and mixtures of hydrocarbon and alcohol fuels. About 25 pounds to about 500 pounds or preferably about 50 to 100 pounds of etherdiamine amide carboxylate per thousand barrels of fuel for internal combusion engines may be used. Liquid hydrocarbon fuels include gasoline, fuel oils and diesel oils. Methyl and ethyl alcohols are examples of alcohol fuels.

In general, the reaction products of the present invention may be employed in any amount which is effective for imparting the desired degree of friction reduction or antioxidant activity. In these applications, the product is effectively employed in amounts from about 0.1% to about 10% by weight, and preferably from about 1% to about 5% of the total weight of the composition.

The following Examples will present illustrations of the invention. They are illustrative only, and are not meant to limit the invention.

EXAMPLE 1

N-Oleyl-1,3-Propylenediamine Partial Formamide, Partial Oleic Acid Salt

Part 1

Approximately 360 g of N-oleyl-1,3-propylenediamine (commercially obtained as Armak Duomeen 0) and 150 g of toluene were charged to a 2 liter reactor equipped with heater, agitator, Dean-Stark tube and condenser with provision for blanketing the vapor space with nitrogen. Slowly, over a period of about 10 minutes, approximately 52 g of 88% formic acid were added with agitation. The reaction mixture was slowly heated to about 160° C. over a period of about 5 hours until water removal by azeotropic distillation ceased. The solvent was removed by vacuum distillation at about 160° C. and the mixture was cooled to about 60° C.

Part 2

Approximately 90% wt. of product of the Part 1 intermediate was then reacted with 250 g of oleic acid at 80° C. for about ½ hour with agitation. The product was a clear amber-colored fluid.

EXAMPLE 2

N-Oleyl-1,3-Propylenediamine Partial Formamide, Partial Lauric Acid Salt

Part 1

Approximately 360 g of N-oleyl-1,3-propylenediamine (commercially obtained as Armak Duomeen 0) and 150 g of toluene were charged to a 2 liter reactor equipped as described in Example 1. Approximately 52 g of 88% formic acid were slowly added and the reaction mixture was heated to about 160° C. over a period of about 5 hours until water removed by azeotropic distillation ceased. The solvent was removed by vacuum distillation at 160° C. and the mixture was cooled to about 60° C.

Part 2

Approximately 20 g of the Part 1 intermediate were charged to a 125 ml reactor equipped with agitator and heater. Approximately 9 g of lauric acid was charged and the reactants were agitated at 60° C. for ¼ hour. The product was a clear amber-colored fluid.

EVALUATION OF THE COMPOUNDS

The compounds were evaluated in a Low Velocity Friction Apparatus (LVFA) in a fully formulated mineral or synthetic, automotive engine oil containing an additive package including antioxidant, dispersant and detergent.

Description

The Low Velocity Friction Apparatus (LVFA) is used to measure the coefficient of friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$. Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the pistor is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammotor arrangment.

Procedure

The rubbing surfaces and 12–13 ml of test lubricants are placed on the LVFA. A 240 psi load is applied and the sliding speed is maintained at 40 fpm at ambient temperature for a few minutes. A plot for coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

TABLE 1

EVALUATION OF FRICTION REDUCING CHARACTERISTICS

| Medium and Additive | Additive Conc. Wt. % | % Reduction in Coefficient of Friction 5 Ft./Min. | 30 Ft./Min. |
|---|---|---|---|
| Base Oil A* | — | 0 | 0 |
| Example 1 (1) | 2 | 69 | 48 |
| | 1 | 61 | 37 |
| Example 2 (1) | 2 | 43 | 24 |
| Base Oil B** | — | 0 | 0 |
| Example 1 (2) | 2 | 69 | 48 |

*Fully formulated SAE 10W/40 100 second paraffinic neutral mineral oil containing other additives as mentioned herein.
**Fully formulated synthetic oil (5W30) containing a detergent/dispersant/inhibitor package.
(1) - In oil A.
(2) - In oil B.

The coefficients of friction were significantly reduced relative to both base oils. Significant reductions in the coefficients of friction were noted with the use of only 1% of Example 1 admixed into a fully formulated mineral oil lubricant. Lower concentrations of less than 1% are also expected to contribute significantly to reductions in friction.

We claim:

1. A compound of the formula:

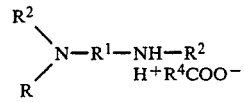

wherein R is a hydrocarbyl group containing 6 to 20 carbon atoms, $R^1$ is a $C_2$ to $C_3$ hydrocarbylene group, $R^2$ is selected from the group consisting of hydrogen and

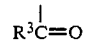

wherein at least one $R^2$ is the latter group in which $R^3$ is selected from the group consisting of hydrogen and a $C_1$ to $C_6$ alkyl group, and $R^4$ is a $C_1$–$C_{20}$ hydrocarbyl group.

2. The compound of claim 1 wherein the hydrocarbyl group is selected from the group consisting of alkyl, aryl, alkaryl, aralkyl and cycloalkyl groups.

3. The compound of claim 1 wherein the hydrocarbylene group is an alkylene group.

4. The compound of claim 1 wherein the diamine portion is derived from a member selected from the group consisting of N-oleyl-1,3-propylenediamine, N-coco-1,3-propylenediamine, N-tallow-1,3-propylenediamine, N-stearly-1,3-propylenediamine, N-hydrogenated tallow-1,3-propylenediamine, N-soya-1,3-propylenediamine, N-hexadecyl-1,3-propylenediamine, N-dodecyl-1,3-propylenediamine, N-linoleyl-1,3-propylenediamine and mixtures thereof.

5. The compound of claim 4 wherein the amide is prepared from a member selected from the group consisting of formic acid, acetic acid, propionic acid, butyric acid and the corresponding esters thereof.

6. The compound of claim 5 wherein the carboxylate is prepared from a member selected from the group consisting of oleic acid, stearic acid, isostearic acid, linoleic acid, tall oil acid, dodecanoic acid, isomeric tridecanoic acid, hexadecanoic acid, lauric acid, myristic acid and mixtures of such acids.

7. The compound of claim 6 wherein the diamine is N-oleyl-1,3-propylenediamine, the acid reacted to form the amide is formic acid and the acid reacted to form the carboxylate is oleic acid.

8. The compound of claim 6 wherein the diamine is N-oleyl-1,3-propylenediamine, the acid reacted to form the amide is formic acid and the acid reacted to form the carboxylate is lauric acid.

9. A lubricant composition comprising a major proportion of a lubricating oil or a grease therefrom and a friction reducing amount of a compound of the formula:

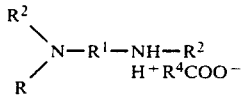

wherein R is a hydrocarbyl group containing 6 to 20 carbon atoms, $R^1$ is a $C_2$ to $C_3$ hydrocarbylene group, $R^2$ is selected from the group consisting of hydrogen and

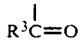

wherein at least one $R^2$ is the latter group in which $R^3$ is selected from the group consisting of hydrogen and a $C_1$ to $C_6$ alkyl group, and $R^4$ is a $C_1$–$C_{20}$ hydrocarbyl group.

10. The composition of claim 9 wherein in the compound the hydrocarbyl group is selected from the group consisting of an alkyl, aryl, alkaryl, aralkyl and cycloalkyl groups.

11. The composition of claim 9 wherein in the compound the hydrocarbylene group is an alkylene group.

12. The composition of claim 9 wherein in the compound the diamine portion is derived from a member selected from the group consisting of N-oleyl-1,3-propylenediamine, N-coco-1,3-propylenediamine, N-tallow-1,3-propylenediamine, N-stearly-1,3-propylenediamine, N-hydrogenated tallow-1,3-propylenediamine, N-soya-1,3-propylenediamine, N-hexadecyl-1,3-propylenediamine, N-dodecyl-1,3-propylenediamine, N-linoleyl-1,3-propylenediamine and mixtures thereof.

13. The composition of claim 12 wherein the amide portion is prepared from a member selected from the group consisting of formic acid, acetic acid, propionic acid, butyric acid and the corresponding esters thereof.

14. The composition of claim 12 wherein the carboxylate portion is prepared from a member selected from the group consisting of oleic acid, stearic acid, isostearic acid, linoleic acid, tall oil acid, dodecanoic acid, isomeric tridecanoic acid, hexadecanoic acid, lauric acid, myristic acid and mixtures of such acids.

15. The composition of claim 14 wherein the diamine used is N-oleyl-1,3-propylenediamine, the acid reacted to form the amide is formic acid and the acid reacted to form the carboxylate is oleic acid.

16. The composition of claim 14 wherein the diamine used is N-oleyl-1,3-propylenediamine, the acid reacted to form the amide is formic acid and the acid reacted to form the carboxylate is lauric acid.

17. The composition of claim 9 wherein the lubricant in said lubricant composition is selected from the group consisting of (1) a mineral oil, (2) a synthetic oil or mixtures of synthetic oils, (3) a mixture of (1) and (2), and (4) a grease from any of (1), (2) and (3).

18. The composition of claim 17 wherein the oil is a mineral oil.

19. The composition of claim 17 wherein the oil is a synthetic oil.

20. The composition of claim 17 wherein the oil is a mixture of synthetic oils.

21. The composition of claim 9 wherein the lubricant is a grease.

22. A method of reducing fuel consumption in an internal combustion engine which comprises a step selected from the group consisting of (1) lubricating said engine with a lubricating oil composition comprising a major proportion of a lubricating oil and a friction reducing amount of a compound of the formula

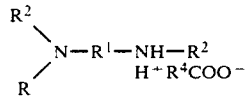

wherein R is a hydrocarbyl group containing 6 to 20 carbon atoms, $R^1$ is a $C_2$ to $C_3$ hydrocarbylene group, $R^2$ is selected from the group consisting of hydrogen and

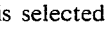

wherein at least one $R^2$ is the latter group in which $R^3$ is selected from the group consisting of hydrogen and a $C_1$ to $C_6$ alkyl group, and $R^4$ is a $C_1$–$C_{20}$ hydrocarbyl group, (2) fueling said engine with a liquid fuel composition comprising a major proportion of a liquid fuel and a fuel consumption reducing amount of said compound and (3) lubricating said engine with said lubricating oil composition and fueling said engine with said liquid fuel composition.

* * * * *